US005198861A

United States Patent [19]

Hasegawa et al.

[11] Patent Number: 5,198,861

[45] Date of Patent: Mar. 30, 1993

[54] IMAGE DENSITY CONTROL METHOD FOR AN IMAGE FORMING APPARATUS FOR REDUCING BACKGROUND CONTAMINATION OF A PHOTOCONDUCTIVE DRUM

[75] Inventors: Shin Hasegawa, Kawasaki; Hajime Oyama, Ichikawa; Eiichi Katoh, Tokyo; Masao Moriya, Yokohama, all of Japan

[73] Assignee: Ricoh Company, Ltd., Tokyo, Japan

[21] Appl. No.: 826,619

[22] Filed: Jan. 28, 1992

[30] Foreign Application Priority Data

Jan. 28, 1991 [JP] Japan ..... 3-8481

[51] Int. Cl.[5] ..... G03G 21/00

[52] U.S. Cl. ..... 355/246; 355/208

[58] Field of Search ..... 355/246, 208, 209, 207

[56] References Cited

U.S. PATENT DOCUMENTS 4,306,804 12/1981 Sakamoto et al. .
4,829,336 5/1989 Champion ..... 355/246
4,878,082 10/1989 Matsushita et al. ..... 355/208

OTHER PUBLICATIONS

Patent Abstracts of Japan, vol. 15, No. 309 (P1235); Abs. Pub. Date Aug. 7, 1991 for Japanese Patent Doc. 03-109584, Pub. May 9, 1991.

Patent Abstracts of Japan, vol. 8, No. 202 (P300); Abs. Pub. Date Sep. 14, 1984 for Japanese Pat. Doc. 59-86074, Pub. May 18, 1984.

Patent Abstracts of Japan, vol. 5, No. 138 (P078); Abs. Pub. Date Sep. 2, 1981 For Japanese Pat. Doc. 56-72467, Pub. Jun. 16, 1981.

*Primary Examiner*—Richard L. Moses

*Attorney, Agent, or Firm*—Oblon, Spivak, McClelland, Maier & Neustadt

[57] ABSTRACT

An image density control method for an image forming apparatus determines the density of a toner image formed on a photoconductive element by a reflection type photosensor and, if the density is low, supplies a toner to a developing unit. A latent image representative of a reference pattern is electrostatically formed on the photoconductive element and then developed by a toner supplied from the developing unit. The supply of a toner to the developing unit is controlled on the basis of the outputs of the sensor associated with the area of the photoconductive element where the pattern image exists and a non-image area. A particular bias voltage is applied to the developing unit for each of the image area and non-image area.

9 Claims, 16 Drawing Sheets

| FIG. 9A |
| --- |
| FIG. 9B |

IMAGE DENSITY CONTROL METHOD FOR AN IMAGE FORMING APPARATUS FOR REDUCING BACKGROUND CONTAMINATION OF A PHOTOCONDUCTIVE DRUM

BACKGROUND OF THE INVENTION

The present invention relates to an image density control method for an image forming apparatus for controlling the density of an image by determining the density of a toner image formed on a photoconductive element by a reflection type photosensor and, if the density is low, supplying a toner to a developing unit.

In an electrophotographic copier, for example, a latent image representative of a pattern having a reference density is electrostatically formed on a photoconductive element outside of an image area. The latent image is developed by a toner to produce a toner pattern image. A reflection type photosensor senses the density of the toner pattern image and the density of the background of the photoconductive element preceding or succeeding the toner pattern image (in the circumferential direction of the element). Whether or not the image density is adequate is determined on the basis of a relation between the two sensed densities. If the image density is low, a toner is supplied to a developing unit to increase the toner concentration of a developer stored in the developing unit.

The output voltage of a reflection type photosensor is associated with the amount of toner deposition on the photoconductive element. However, such a photosensor has a problem left unsolved, as follows. When the photosensor is of the type outputting a high level voltage in response to a high density, the output voltage thereof becomes saturated in an area where a substantial amount of toner is deposited, e.g., in a solid image portion having a substantial area. On the other hand, when use is made of a photosensor of the type outputting a low level voltage in response to a high density, the output thereof approaches the base value in the above-mentioned area. In any case, the output voltage of the photosensor does not noticeably change despite the change in the density of the object, i.e., the sensitivity is low. Hence, the photosensor cannot satisfactorily respond to the increase and decrease in the amount of toner deposition. Should the sensitivity be increased for a high density area, it would be lowered in a low density area and substantially prevent the density from being sensed in an area where the amount of toner deposition is extremely small. Conversely, should the sensitivity be increased for a low density area, it would be substantially impossible to sense the density in a high density area such as a solid image portion. To eliminate this problem, it has been customary to select a lower potential for the toner pattern image than for the solid image portion to thereby form a halftone pattern image. The photosensor detects the change in the amount of toner deposition on such a halftone pattern image. To set up the potential for the halftone pattern image, the charge potential (absolute value) is reduced and/or the bias voltage (absolute value) to be applied to the developing roller is increased, compared to the potential for the image area. For example, Japanese Patent Laid-Open Publication No. 241571/1989 proposes a device for automatically changing the bias voltage for development.

As stated above, it is a common practice to assign a particular image forming condition to each of the image area and the non-image area or marginal area for forming the toner pattern image. However, the same image forming condition is assigned to the non-image area and the background, i.e., the background is processed under the condition which is optimal for sensing the density of the toner pattern image. It follows that the background allows a carrier included in the developer to deposit thereon or is excessively contaminated depending on the resistance of the carrier and the amount of charge deposited on the toner, preventing the background density from being accurately sensed.

SUMMARY OF THE INVENTION

It is, therefore, an object of the present invention to provide an image density control method for an image forming apparatus capable of controlling the image density with accuracy by sensing the density of a toner pattern image and that of the background accurately.

In accordance with the present invention, in an image density control method comprising the steps of exposing the charged surface of a photoconductive element by a reference pattern having a high density to electrostatically form a corresponding latent image on the element, developing the latent image by a toner stored in a developing unit to convert it to a toner pattern image, sensing a reflection from the toner pattern image and a reflection from a non-image area on the photoconductive element by a photosensor, and controlling the supply of a toner to the developing unit on the basis of a correlation between the sensed reflections, the toner pattern image is formed under a particular image forming condition which causes the output of the sensor to lie in a range where a sensed value noticeably changes in response to a change in density, while the non-image area is formed under another particular image forming condition which contaminates the background less than the particular image forming condition assigned to the pattern image.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
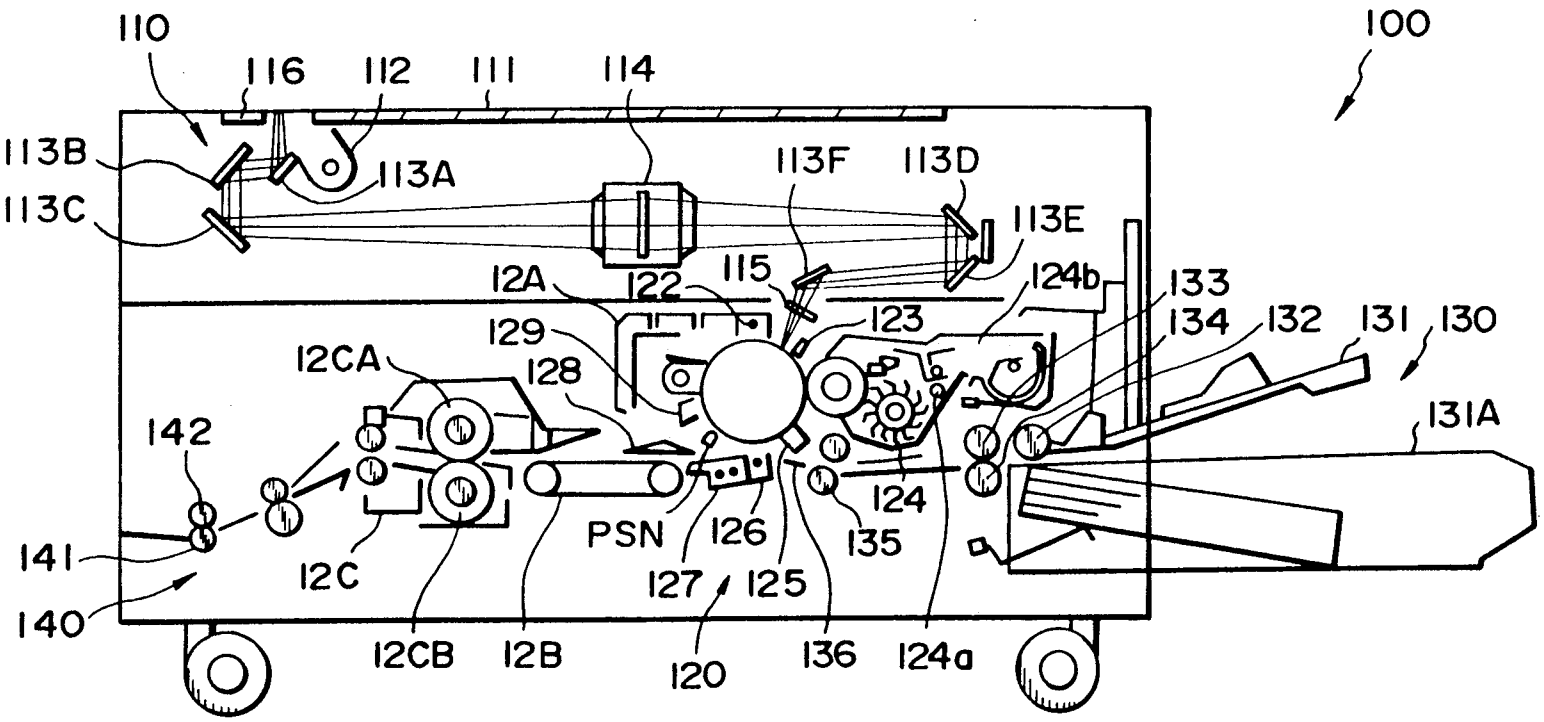
FIG. 1 is a side elevation showing a copier with which the image control method of the present invention can be practiced.

Referring to FIG. 1 of the drawings, a copier for praticing the method of the present invention invention is shown and implemented as an electrostatic image transfer type copier. In this type of copier, a document to be reproduced is fixed in place. As shown, the copier, generally 100, has optics 110, an image forming section 120, a paper feeding section 130, and a paper discharging section 140. The optics 110 has a glass platen 111, a lamp 112, mirrors 113A, 113B, 113C, 113D, 113E and 113F, a lens 114, and a dust-proof glass 115. The image forming section 120 has a photoconductive drum 121. Arranged around the drum 121 are a main charger 122, an eraser 123, a developing unit 124, a pretransfer charger 126, a charger 127 for paper separation, a separator in the form of a pawl 128, a precleaning charger 129, and a cleaner 12A. A transport belt 12B and a fixing unit 12C are located downstream of the drum 121 with respect to an intended direction of paper transport. The paper feeding section 130 has a tray 131 for manual paper insertion, a tray 131A for automatic paper feed, a pick-up roller 132, a feed roller 133 and a reverse roller 134 which are shared by the trays 131 and 131A, a register roller 135, a Mylar sheet 136 serving as a guide, and various guides and intermediate rollers. The paper discharging section 140 has a discharge roller 141 and a roller 142 movable into and out of contact with the roller 141.

After a document has been laid on the glass platen 111, a copy start command is entered. In response, a paper feed clutch is coupled to cause the pick-up roller 132 to drive a paper sheet from either of the trays 131 and 131A being selected toward the feed roller 133. The feed roller 133 feeds the paper sheet toward the register roller 135. On the other hand, the optics 110 scans the document laid on the glass platen 111, i.e., the lamp 112 illuminates the document. The resulting imagewise reflection from the document is routed through the mirrors 113A, 113B, 113C, lens 114, mirror 113D, mirror 113E, mirror 113F and dust-proof glass 115 to the drum 121.

The drum 121 is rotated counterclockwise as viewed in the figure and has the surface thereof uniformly charged by the main charger 122. The eraser 123 forms an image forming area on the charged surface of the drum 121. The reflection from the document is incident to the drum 121 and electrostatically forms a latent image thereon. The developing unit 124 develops the latent image by a toner. As a result, a toner image is formed on the drum 121 in association with the density distribution of the document. Before the toner image is transferred to the paper sheet which will be fed from the register roller 135, a pretransfer lamp 125 discharges the surface of the drum 121 to promote easy image transfer.

The paper sheet fed from the register roller 135 is urged against the surface of the drum 121 by the Mylar sheet 136. The toner image is transferred from the drum 121 to the paper sheet at a position just above the transfer charger 126. The separation charger 127 separates the paper sheet carrying the toner image from the drum 121. If the separation of the paper sheet from the drum 121 is not sufficient, the separator 128 forcibly separates the former from the latter. The cleaner 12A removes the toner remaining on the drum 121 after the image transfer. The paper sheet with the toner image is transported to the fixing unit 12C by the belt 12B. Made up of a heat roller 12CA and a pressure roller 12CB, the fixing unit 12C fixes the toner image on the paper sheet by heating the paper sheet (about 185° C.) while pressing it. The paper sheet coming out of the fixing unit 12C is driven toward the paper discharging section 140. In this section 140, the discharge roller 141 cooperates with the roller 142 to drive the paper sheet, or copy, to the outside of the copier.

In FIG. 1, the reference numeral 116 designates a reference pattern for image density control. A density sensor (sometimes referred to as a P sensor hereinafter) PSN is implemented by a reflection type photosensor and senses density in the event of density control. A toner supply roller **124*a* supplies a toner from a toner hopper 124*b* to the developing unit 124** while having the rotation thereof controlled on the basis of the output of the P sensor PSN, as will be described later specifically.

Figure 2:
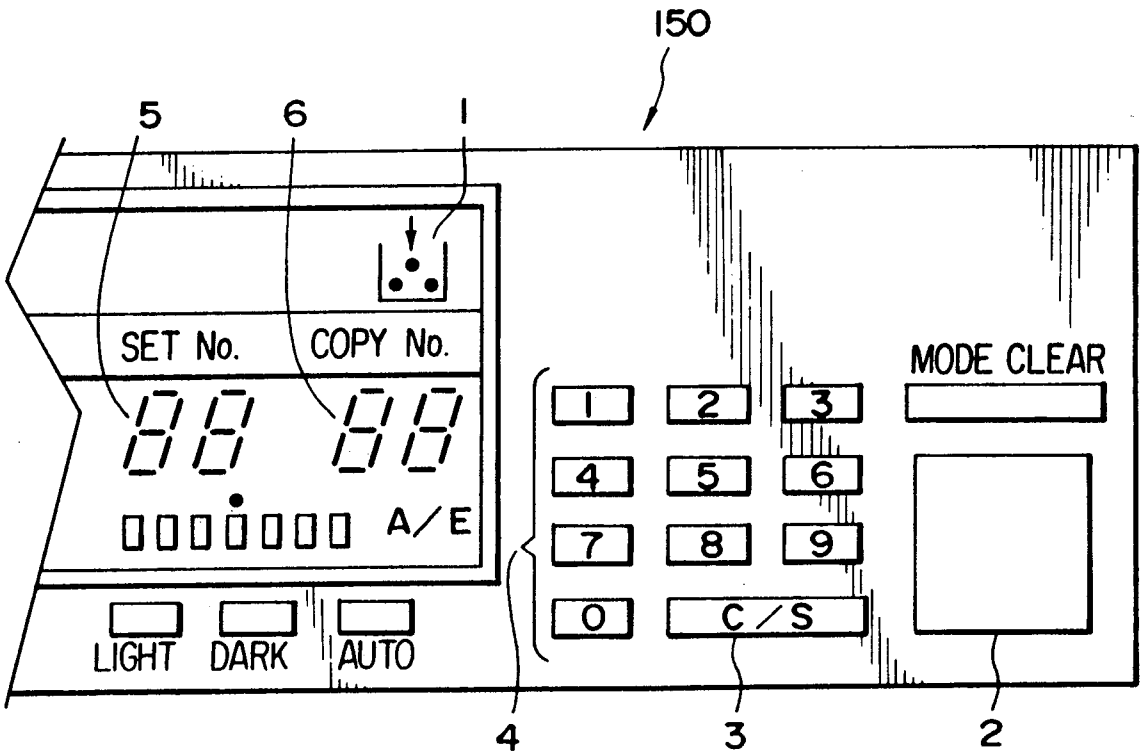
FIG. 2 is a plan view showing an operation and display board provided on the copier shown in FIG. 1.

FIG. 2 shows part of an operation and display board 150 provided on the copier 100. As shown, the board 150 has a toner end indicator 1 which flashes in a toner near end condition and glows in a toner end condition. A print start key 2 is operated to enter a copy start command. A stop/clear key 3 is accessible for clearing the desired number of copies entered or interrupting a copying operation under way. Numeral keys 4 are usable to enter a desired number of copies or similar numerical value. 7-segment displays 5 and 6 indicate respectively the number of documents set and the number of copies having been produced. Also provided on the board 150 are various keys and displays for density adjustment, magnification change, two-sided copy mode and so forth, although not shown in the figure.

Figure 3:
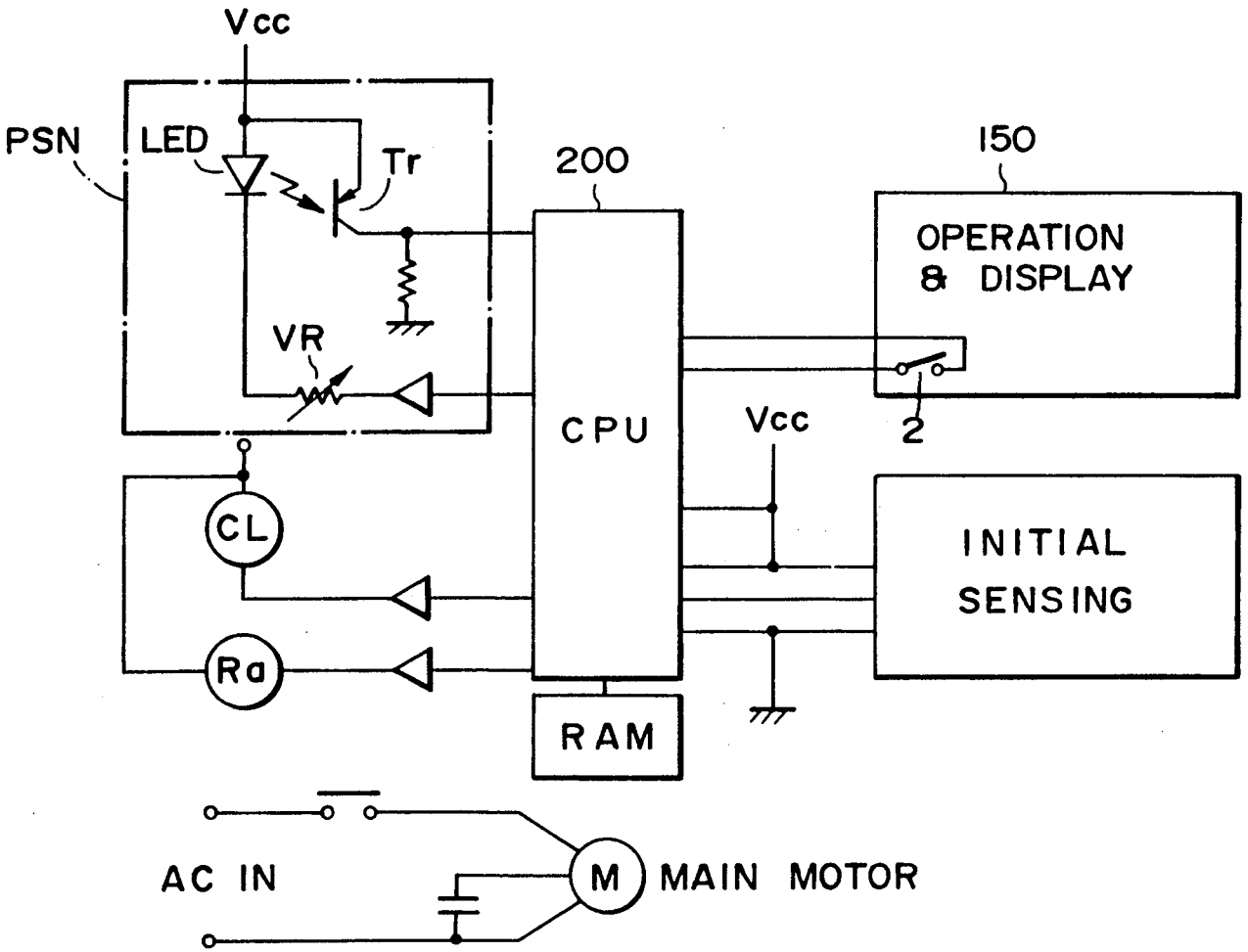
FIG. 3 is a block diagram schematically showing a control system incorporated in the copier shown in FIG. 1.

Image density control will be outlined with reference to FIG. 3 showing a control system as well as to FIGS. 1 and 2. When the copy start key 2 of the operation and display board 150 is pressed, the optics 110 illuminates the reference pattern 116. The resulting reflection from the reference pattern 116 is incident to the surface of the drum 121 whose surface has been charged by the main charger 122, whereby a latent image representative of the pattern 116 is electrostatically formed on the drum 121. After the latent image has been developed by the developing unit 124, the P sensor PSN disposed below the cleaning unit 12A reads the resulting toner image. As shown in FIG. 3, the P sensor PSN has a light emitting diode LED, and a variable resistor VR for adjusting the quantity of light to issue from the diode LD. The light to issue from the light emitting diode LED is adjusted beforehand such that when the diode LED is turned on, the sensor, i.e., a phototransistor Tr included in the sensor produces an output of 4 V. The output of the P sensor PSN is applied to the input terminal of an analog-to-digital converter (ADC) included in a CPU 200. In response, the CPU 200 compares an input voltage (Vsg) associated with the area of the drum 121 where no toner has been deposited with an input voltage (Vsp) associated with the above-mentioned toner pattern image. When a relation $Vsg \leqq Vsp \times 8$ holds, the CPU 200 couples the toner supply clutch, i.e., rotates the toner supply roller **124*a* for a predetermined period of time. If $Vsg > Vsp \times 8$, the CPU 200 uncouples the clutch, i.e., stops the rotation of the roller 124*a***.

The operation of the CPU 200 will be described specifically. To begin with, the CPU 200 executes initialization in the event that a new developing unit is mounted or the developer is replaced. For the initialization, the CPU 200 forms a toner image representative of the reference pattern 116 on the drum 121, causes the P sensor PSN to sense the density of such a pattern image, and reads the resulting output of the PSN by the ADC built therein. The initialization is effected in a free run mode, i.e., without a paper sheet. While the optics 110 and image forming section 120 are operated basically in the same manner as during the ordinary image forming operation, the eraser 123 discharges the surface of the drum 121 except for the toner pattern area. In the free run mode, the reference pattern 116 is scanned twenty times to form twenty patterns in total, i.e., one pattern per scanning in the leading edge portion of the image area of the drum 121. A P sensor pattern sampling procedure (FIG. 4) and an initializing procedure (FIG. 5) are executed during the initialization, as follows.

Figure 4:
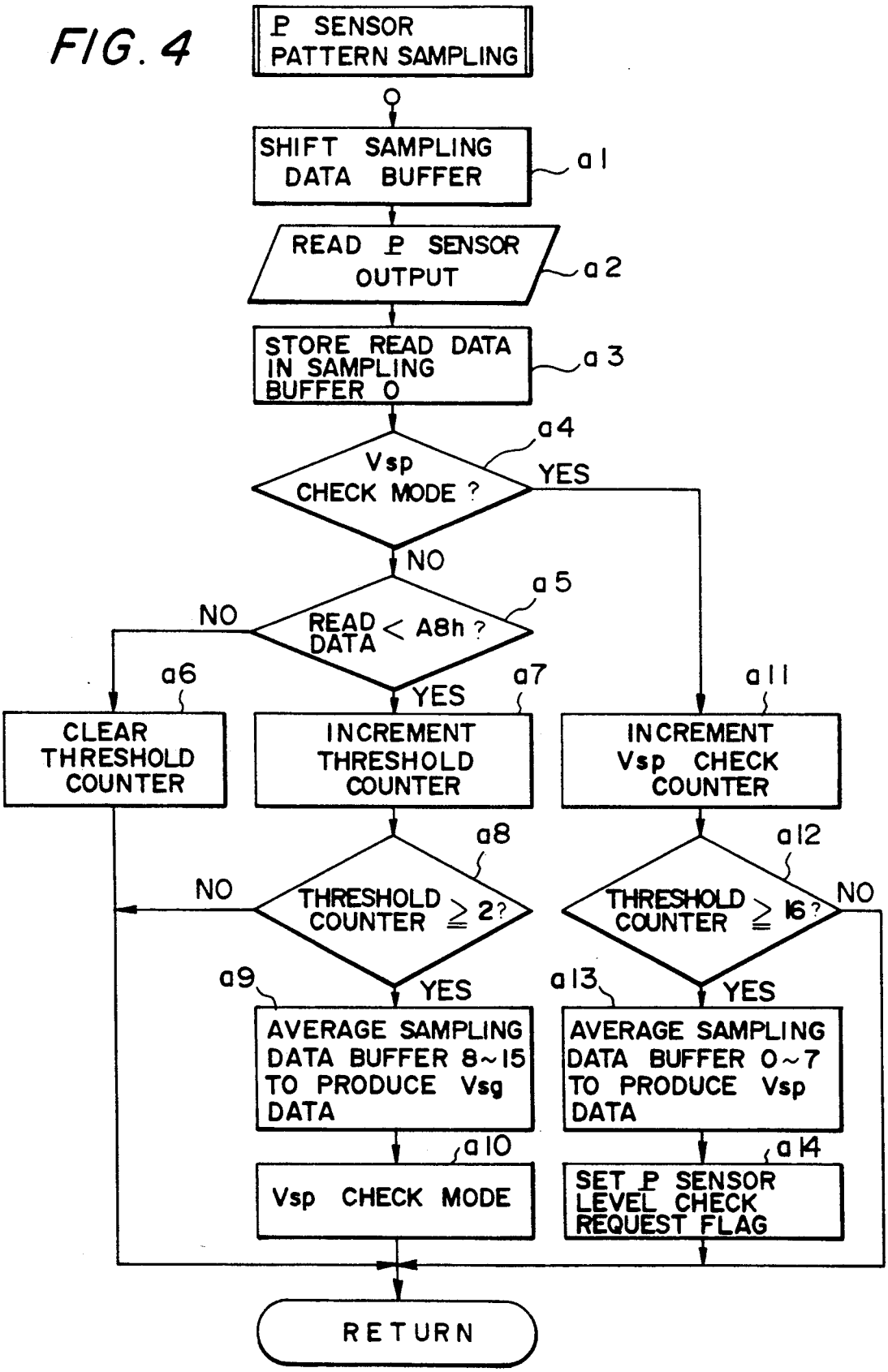
FIGS. 4–12 are flowcharts each showing some specific procedures to be executed by a CPU (Central Processing Unit) included in the control system.

Referring to FIG. 4, the P sensor pattern sampling procedure is executed at a predetermined interval (e.g. 4 msec) between the time when the LED of the P sensor PSN is turned on to read a toner pattern density level and the time when the sampling ends. Data are read by the ADC of the CPU 200 in the form of OOh–FFh which correspond to 0–5 V, respectively. For example, when the data is A8H, the output voltage of the P sensor PSN is 3.3 V. The LED is turned on when the background of the drum 121 preceding the toner pattern reaches it, thereby sequentially sampling the background and toner pattern (steps a1–a3). The threshold level of the background and toner pattern is determined to be A8H. In a mode other than a Vsp check mode (NO, a5), the CPU 200 averages eight data obtained fifteen to eight samples before the time when sampling data lower than the threshold has occurred two consecutive times, thereby producing Vsg data (a4–a10). Then, the CPU 200 sets up the Vsp check mode. In the Vsp check mode, the CPU 200 averages eight data obtained nine to sixteen samples before the time when sampling data lower than the threshold level has occurred two consecutive times and uses the mean value as Vsp data (a4 and a11–a13). On obtaining the Vsg data and Vsp data, the CPU 200 sets a P sensor level check request flag (a14) to end the sampling operation. A threshold counter, not shown, and a Vsp check counter, not shown, are initialized before the toner pattern sampling begins.

Figure 13:
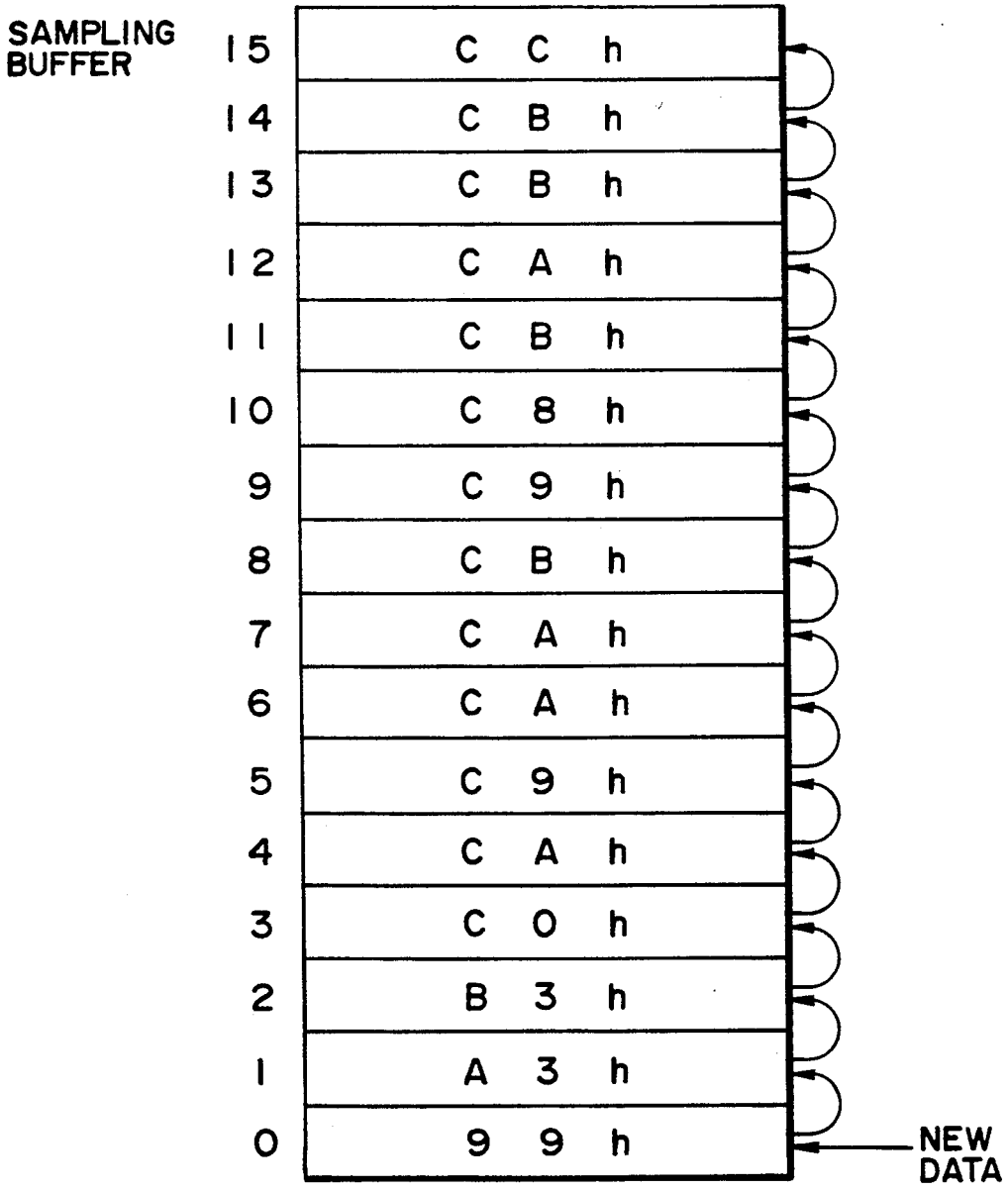
FIG. 13 is a memory map represenative of a RAM (Random Access Memory) for storing sampling data associated with a toner pattern.

FIG. 13 shows a 16-byte RAM serving as a buffer for storing the above-stated sampling data. As new data is read by the sampling a1–a3, data stored in the buffer are shifted one byte upward to store the new data in the lowermost address 0 of the buffer. Hence, latest sixteen data are always stored in the buffer.

Figure 5:
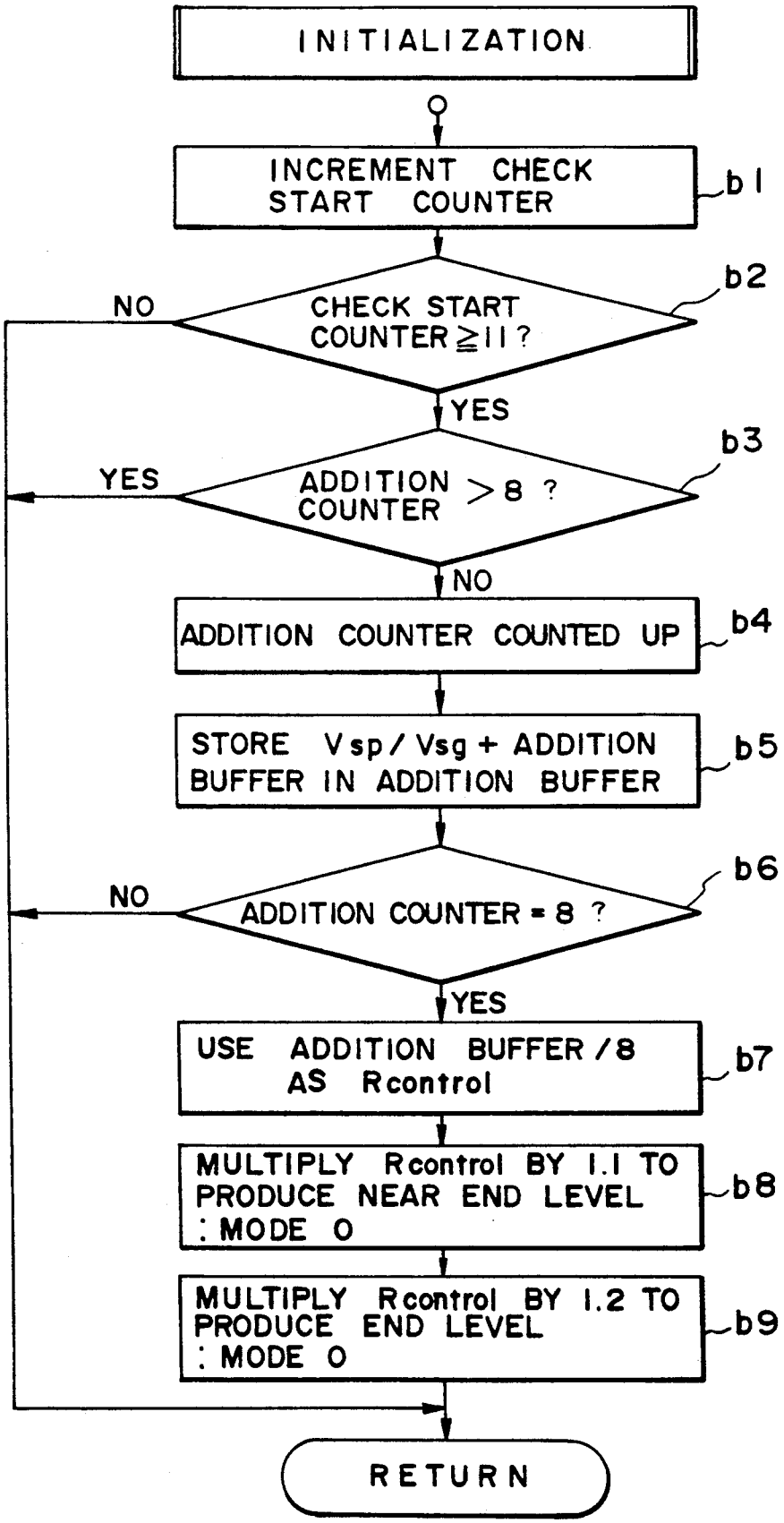

Referring to FIG. 5, the initializing procedure is executed after the toner pattern sampling procedure described above. During ordinary copying operations, a P sensor level check procedure which will be described with reference to FIGS. 9 and 10 precedes the initializing procedure. First, the CPU 200 obtains toner density data and other reference data. The first ten times of scanning is effected to allow a new developer to adapt itself to the copier; no toner pattern is formed (an agitator in the form of a roller disposed in the developing unit is driven at predetermined timings). Up to the tenth scanning, the programs skips steps b3–b9 since the answer of a step b2 is NO. The CPU 200 averages sampling data (Vsp/Vsg) derived from the eleventh scanning to the eighteenth scanning (eight times of scanning) and uses the mean value as Rcontrol (b3–b7). Further, the CPU 200 multiplies Rcontrol by 1.1 to produce a near end level:mode 0 (b8) and multiplies Rcontrol by 1.2 to produce an end level:mode 0 (b9). These products are used to control the toner supply and to detect a toner end condition. Rcontrol, end level:mode 0 and near end level:mode 0 are continuously used up to the next initialization.

Eighteen times of scanning suffices the above procedure, and the remaining two times of scanning will be used when an error occurs in the toner pattern sampling. A check counter, an addition counter and an addition buffer are cleared at the time of initialization.

The toner concentration is controlled while a copying operation is under way, as follows. An image representative of the reference pattern 116 is formed on the drum 121 between nearby image portions, once or twice per five copying cycles. Every time such a reference pattern image is formed, the density level thereof is determined and compared with Rcontrol, end level:mode 0 and near end level:mode 0 to thereby effect toner concentration control and toner end detection. The density level is compared not only with the level particular to a developing unit but also with an absolute level which will be described in relation to a mode 1.

Figure 6:
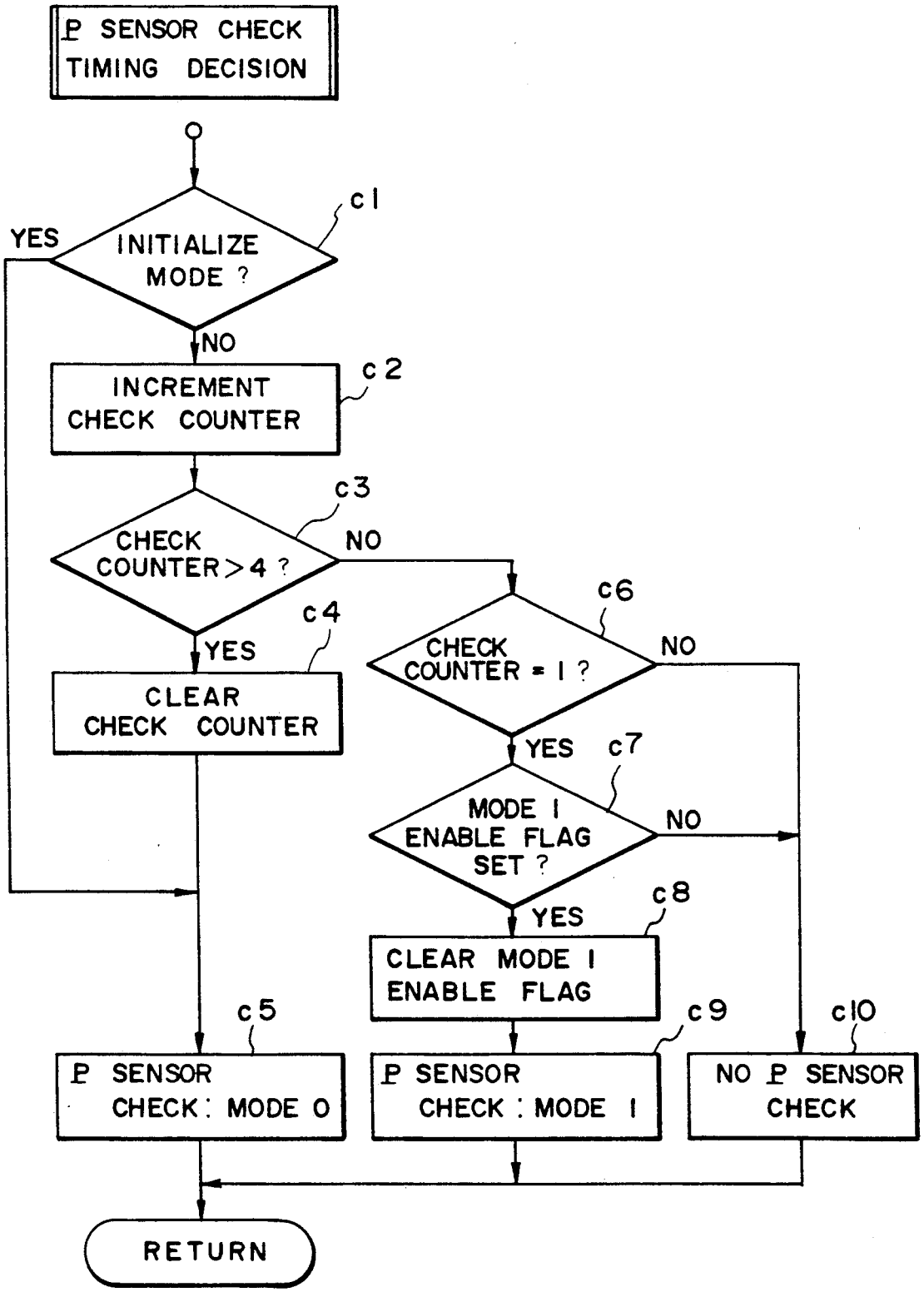

FIG. 6 shows a procedure for determining a P sensor check timing, i.e., whether or not to form a reference toner pattern and read the density thereof at a position preceding the leading edge of the next copy (scanning). This routine is recalled once per copy. At the time of initialization, P sensor checking is effected in a mode 0 without exception (c1 and c5). The P sensor checking in the mode 0 is also executed once per five copying cycles (when a check counter is 0) (c2–c5). Further, when the check counter is 1 and a mode enable flag is set, P sensor checking is effected in a mode 1 (c6–c9); otherwise, P sensor checking is not effected at all (c1–c3, c6 and c10). The mode 1 enable flag is set by the P sensor level check procedure shown in FIGS. 9 and 10.

Figure 7:
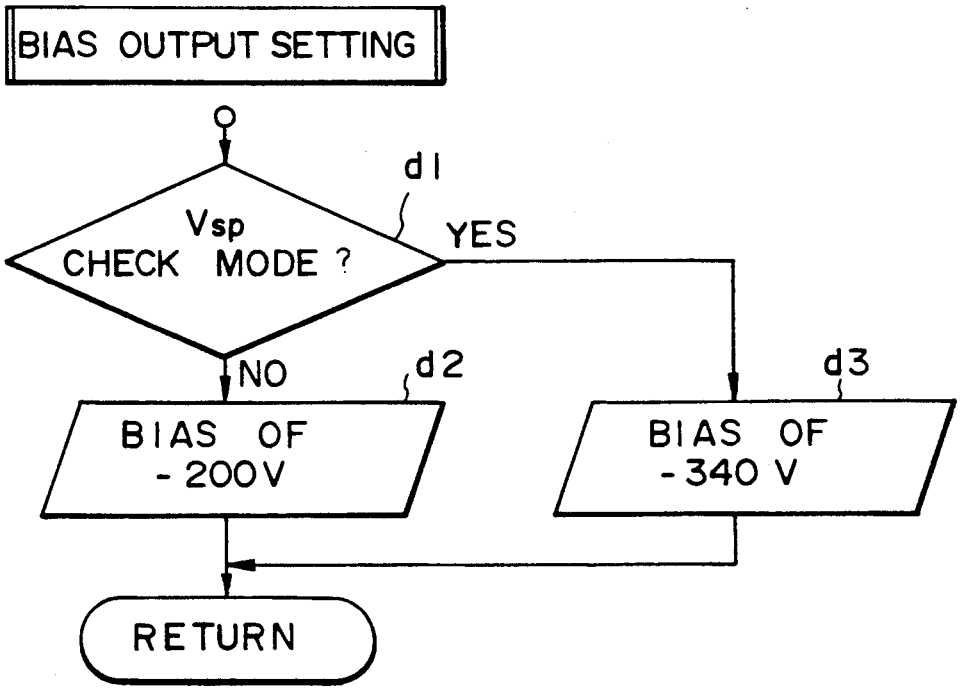

FIG. 7 shows a routine for setting a bias voltage and which is recalled continuously from a predetermined time before the leading edge of a latent image to form a toner pattern reaches the developing roller to the time when the trailing edge of the same moves away from the developing roller. The output value differs from the time when the density of the background is sensed to the time when the density of the pattern is sensed. When the Vsp check mode is not set, a bias voltage of −200 V is applied to the developing unit 124 (d1 and d2). When the Vsp check mode is set, a bias voltage of −340 V is applied (d1 and d3). It is to be noted that the output value assigned to an image portion (which changes on the basis of the specified finish density or the result of automatic density adjustment) is selected a predetermined period of time before the leading edge of the latent image reaches the developing roller.

Figure 8:
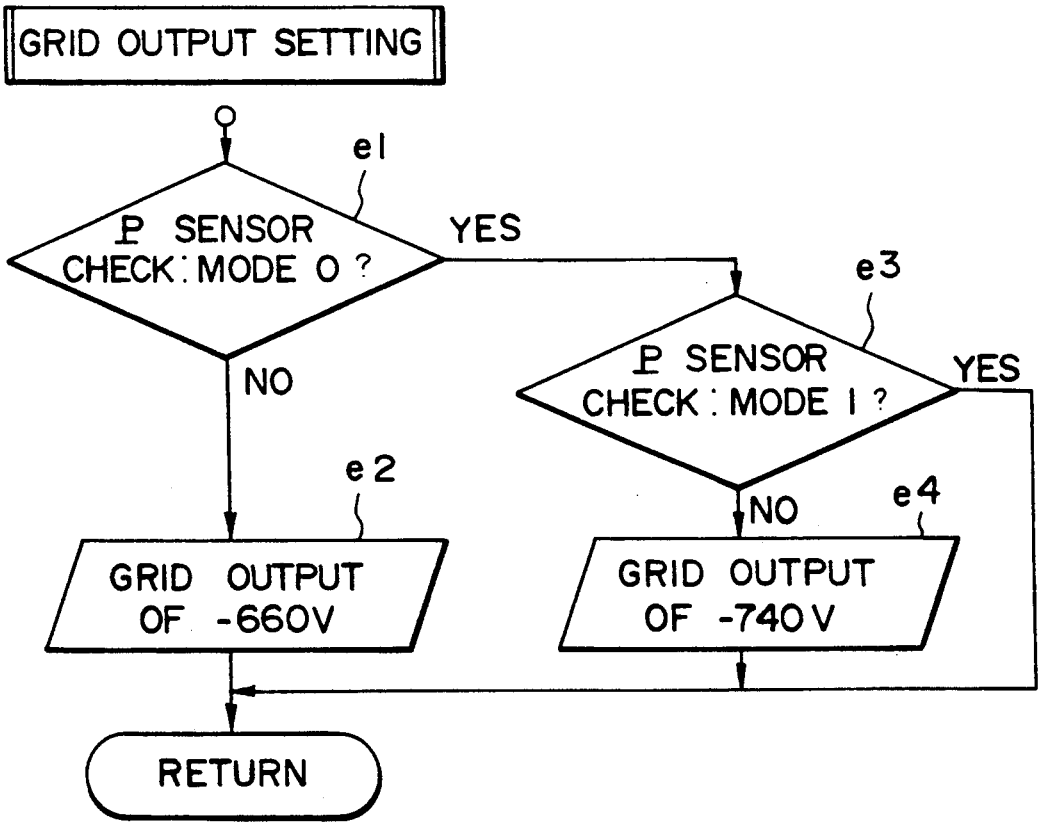

FIG. 8 shows a grid output setting routine which is executed at a predetermined time before the portion of the drum where the toner pattern should be formed reaches the main charger. In this routine, a grid output is set in matching relation to the P sensor check mode. Specifically, a grid output of −660 V is set in the P sensor check: mode 0 (e1 and e2) while a grid output of −740 V is set in the P sensor check: mode 1 (e3 and e4). In modes other than the P sensor check: mode 0 and P sensor check: mode 1, the grid output is not set.

Figures 9, 9A:
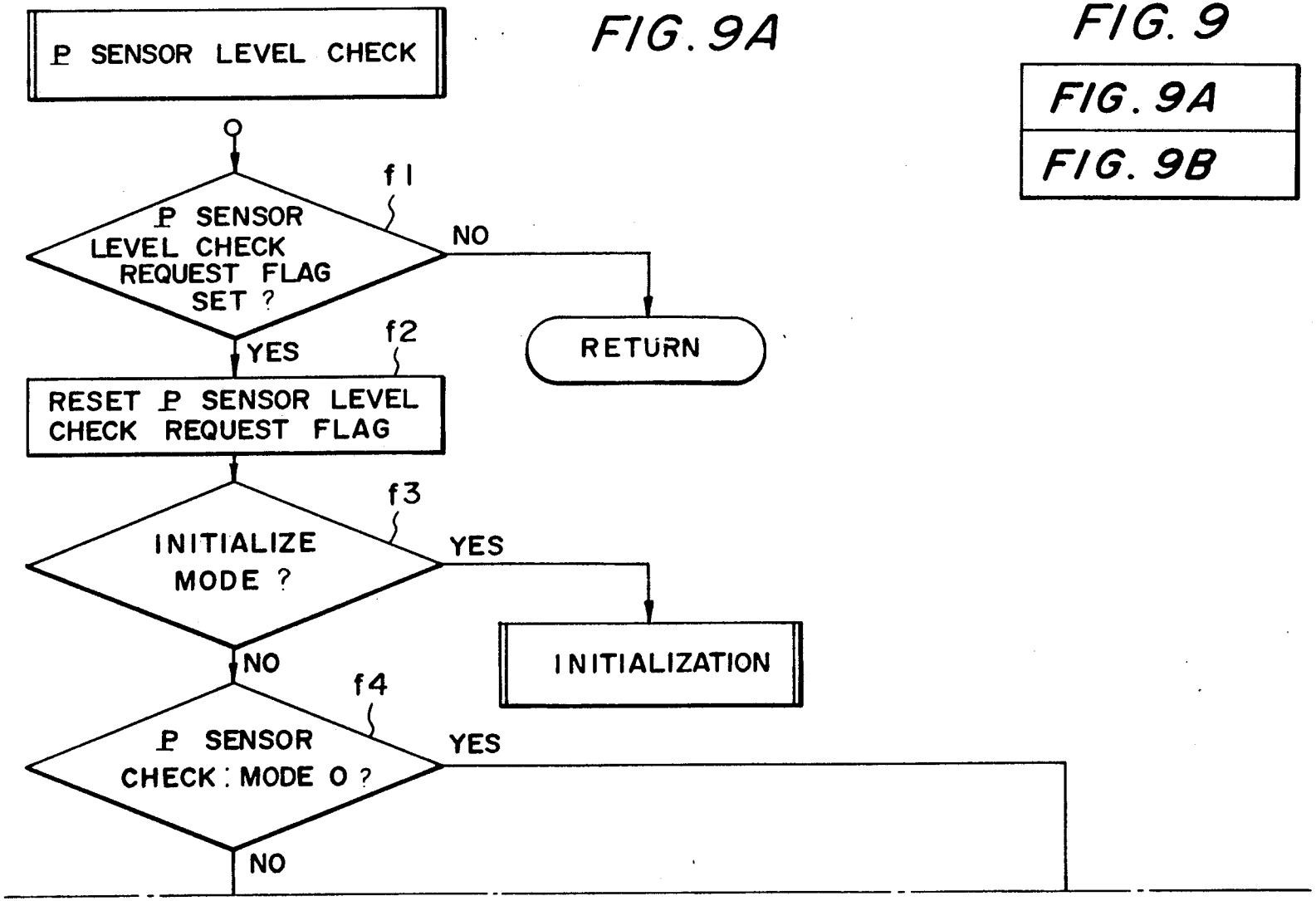
Figure 9B:
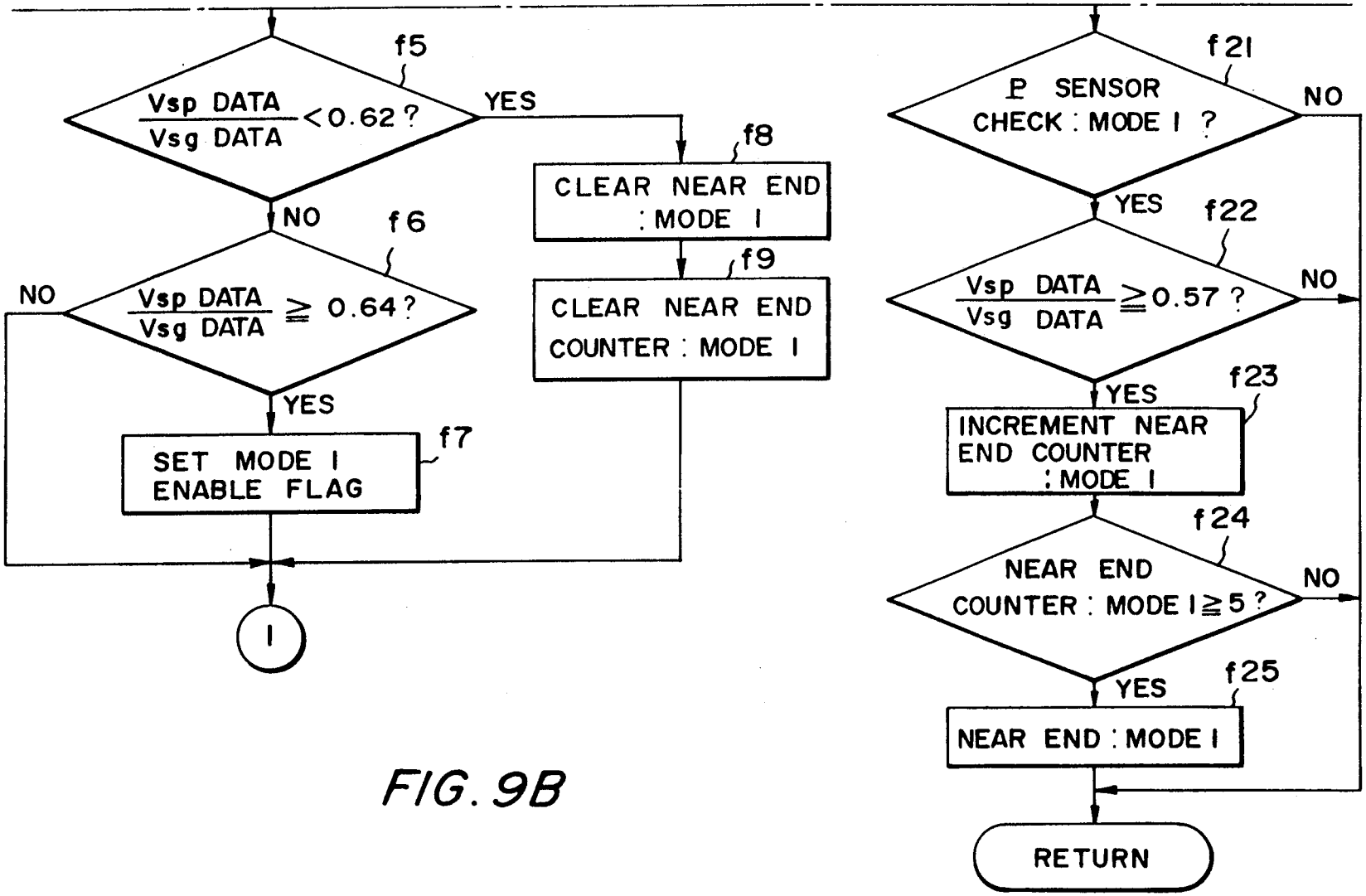
Figure 10:
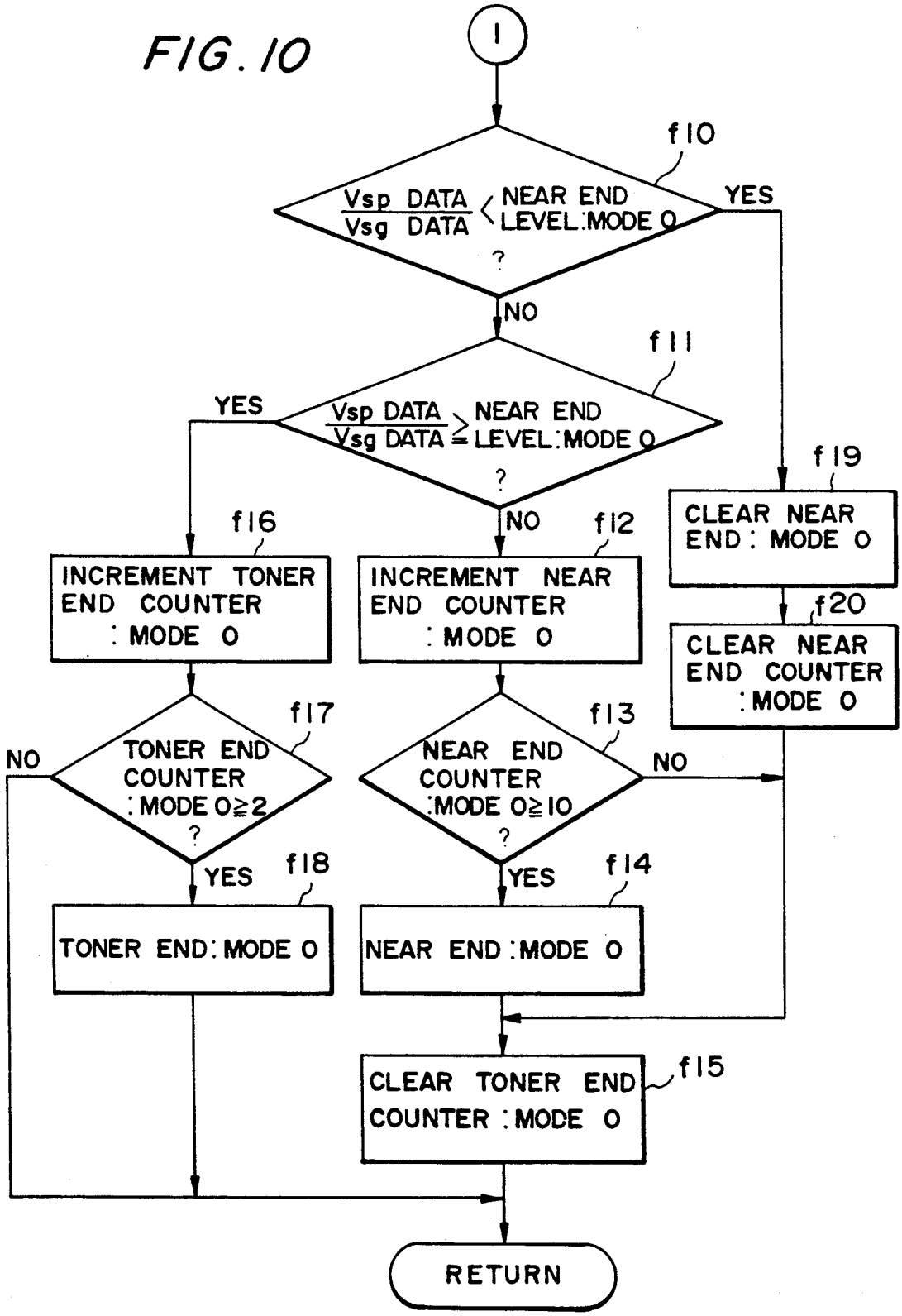

Referring to FIGS. 9 and 10, the P sensor level check routine is executed when the toner pattern density sampling ends in the P sensor pattern sampling procedure, FIG. 4, i.e., when the P sensor level check request flag is set. By this routine, whether or not a toner end condition has been reached is determined. If an initialize mode is set, the initializing procedure shown in FIG. 5 is executed.

When the initialize mode is not set and the P sensor check mode is 0 (the check counter is 0 in a flow 1), the CPU 200 performs the following operation (f4). First, the CPU 200 determines whether or not P sensor checking in the mode 1 should be executed next. If $Vsp/Vsg \geqq 0.64$, the mode 1 enable flag is set, and then the P sensor check: mode 1 is set up in the following flow 1. If $Vsp/Vsg < 0.62$, a near end counter: mode 1 for counting the number of times that the actual level exceeds the near end level is cleared. Subsequently, the end of toner in the mode 0 is checked. When $Vsp/Vsg \geqq$ endless level: mode 0 occurs two consecutive times, the toner end: mode 0 is set up; when $Vsp/Vsg \geqq$ near end level: mode 0 occurs ten consecutive times, a near end: mode 0 is set up (f5–f20). The toner end counter: mode 0 and near end counter: mode 0 each determines the time that Vsp/Vsg exceeds the associated level consecutively.

When the initialize mode is not set and the P sensor check mode is 1 (the check counter in the flow 1 is 1), the CPU 200 executes the following procedure (f21). If $Vsp/Vsg \geqq 0.57$, the CPU 200 sets up the near end counter:mode 1 and increments the counter. If near end counter:mode $1 \geqq 5$, the CPU 200 sets up the near end mode 1 (f22–f25). It is to be noted that the near end counter:mode 1 is not cleared even when $Vsp/Vsg < 0.57$ (cleared if $Vsp/Vsg < 0.62$ in the check mode 0).

Figure 11:
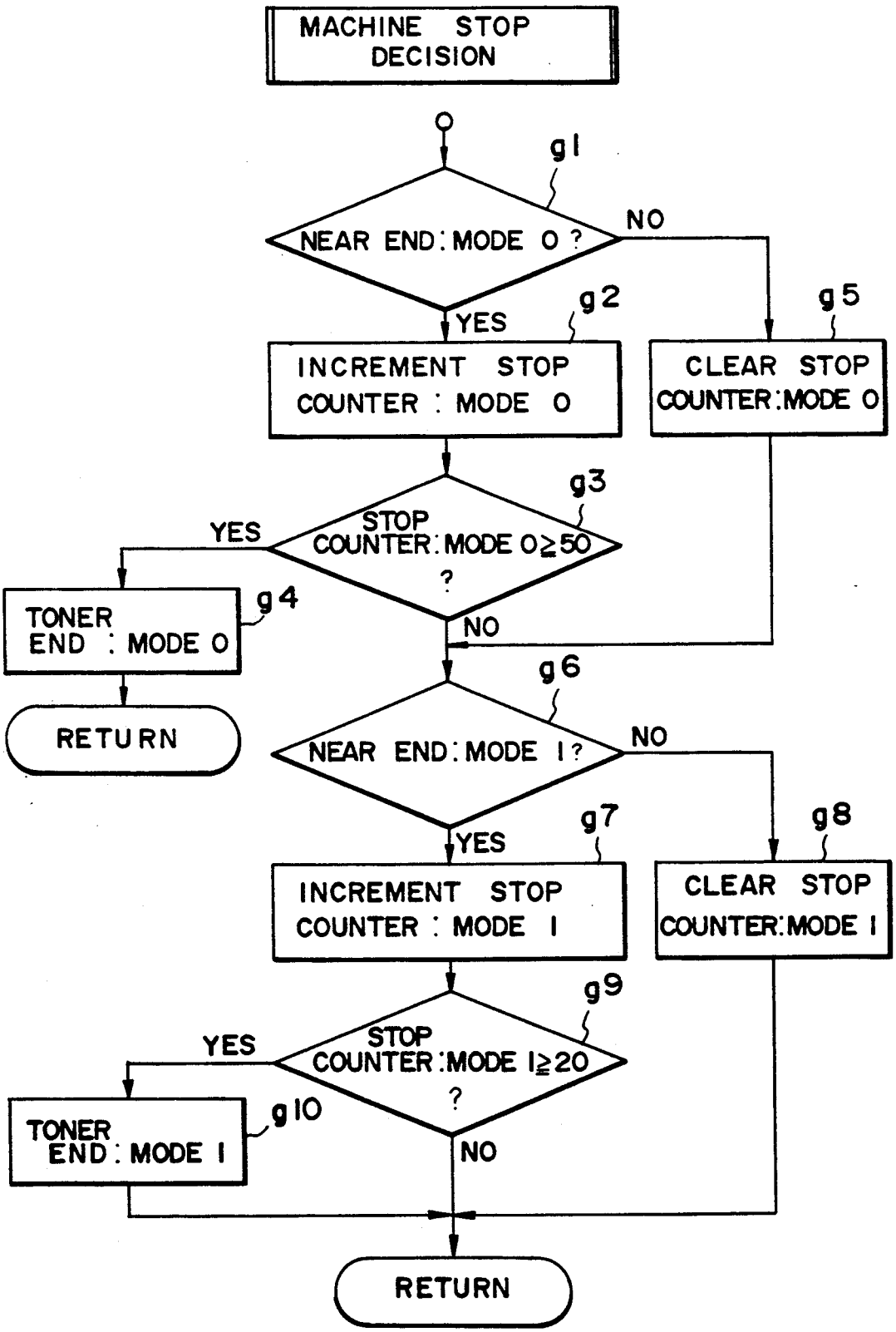

FIG. 11 shows a routine for determining whether or not to stop the operation of the copier and which is recalled at the same timing as the routine for determining the P sensor check timing, FIG. 6. When the copying cycle is repeated fifty times under the near end:mode 0 condition, the CPU 200 sets up a toner end:mode 0 (g1–g5). When the copying cycle is repeated twenty times under the near end:mode 1 condition, the CPU 200 sets up a toner end mode 1 (g6–g10). While a repeat copy mode is under way, the CPU 200 interrupts the repetition and inhibits the copier from operating. Likewise, when the toner end:mode 0 or the toner end:mode 1 is set up in the procedure shown in FIGS. 9 and 10, the CPU 200 interrupts the repetition and prevents the copier from operating.

Figure 12:
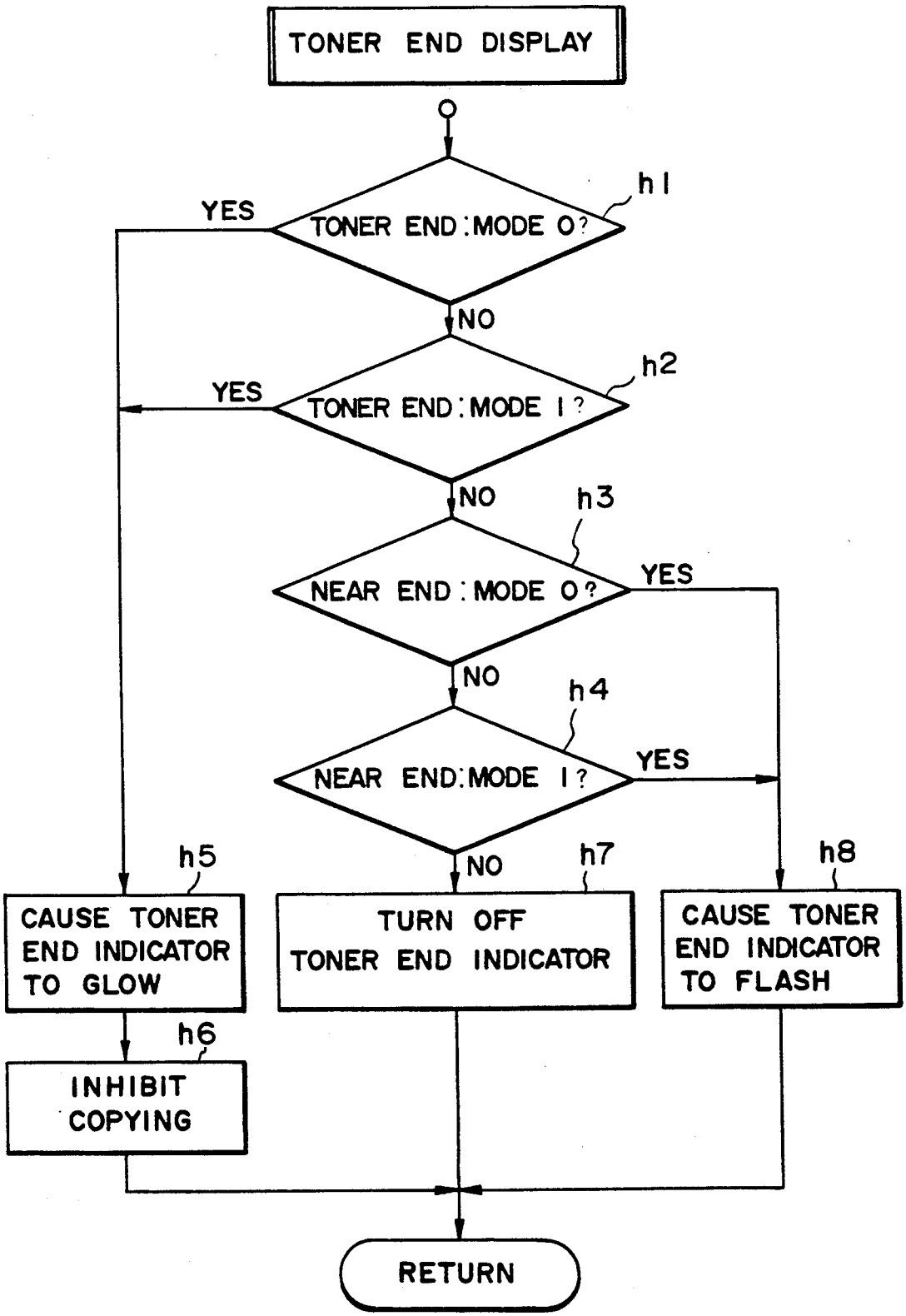

FIG. 12 shows a toner end display routine which is constantly recalled. In the toner end condition, the toner end indicator 1 provided on the operation board 150 glows to inhibit the copying operation (h1, h2, h5 and h6). In the toner near end condition, the toner end indicator 1 flashes (h3, h4 and h8), and the copying operation is not inhibited. When neither the toner end condition nor the toner near end condition is reached, the toner end indicator 1 is turned off and the program returns (h1–h4 and h7).

Figure 14:
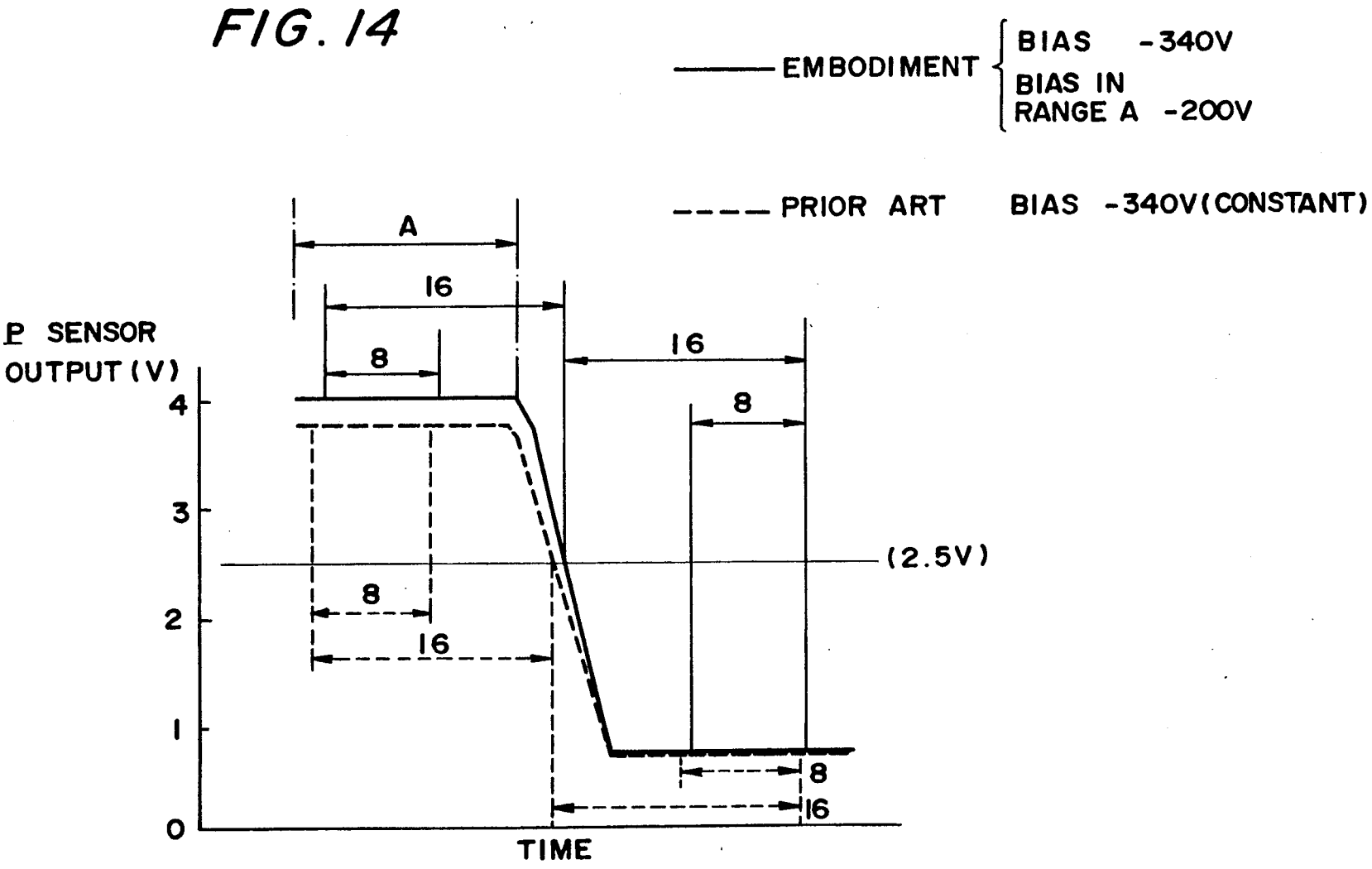
FIG. 14 is a graph indicative of the output characteristic of a density sensor with respect to a pattern image area and a non-pattern image area.

FIG. 14 indicates timings for determining Vsp and Vsg, i.e., the output of the photosensor associated with the background and toner pattern. As shown, former eight of sixteen sampling data higher than a boundary level of 2.5 V is averaged to produce a mean value Vsg, while latter eight of sixteen sampling data lower than 2.5 V are averaged to produce a mean value Vsp. In the illustrative embodiment, while a bias voltage Vb of −340 V is assigned to Vsp detection, a bias voltage Vb of −200 V is assigned to Vsg detection (range A) to prevent Vsp from being lowered by the deposition of toner charged to the opposite polarity.

Figure 15:
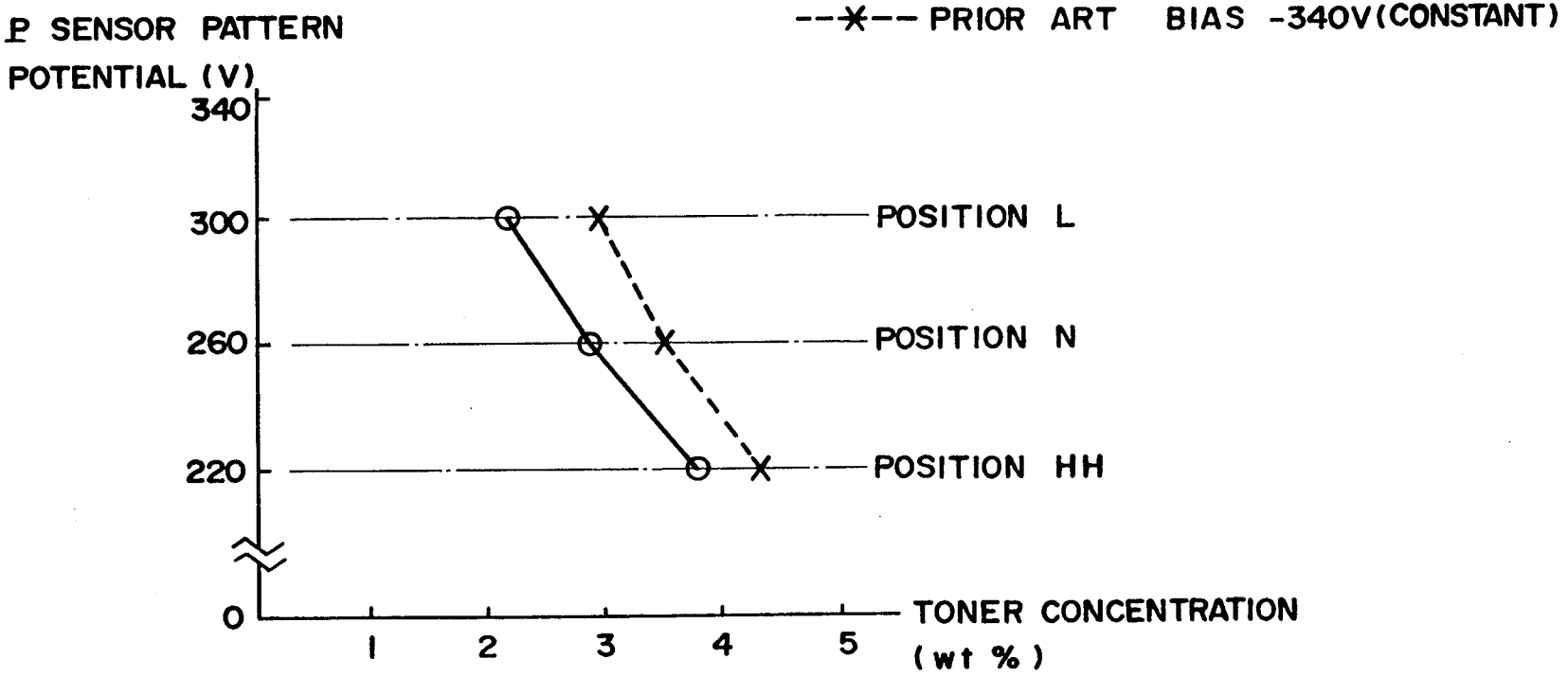
FIG. 15 is a graph showing a relation between the density sensor potential energy and the tone density with respect attainable with the embodiment and a conventional relation.
Figure 16:
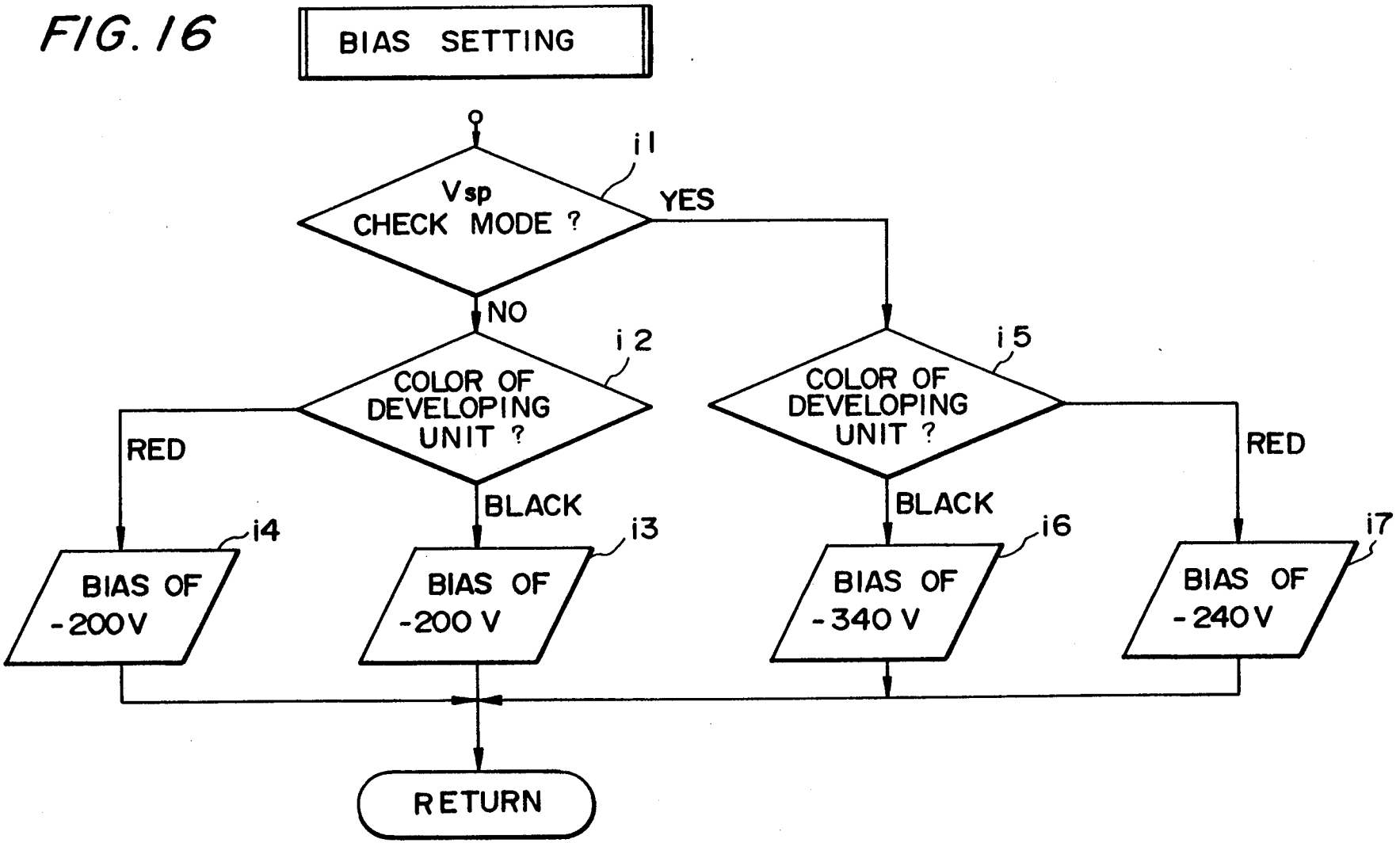
FIG. 16 is a flowchart demonstrating a specific procedure suitable for a copier having a plurality of developing units.

FIG. 15 shows the toner concentration control of the embodiment and conventional toner concentration control for comparison. In FIG. 15, the ordinate and the abscissa indicate the P sensor potential and the toner concentration, respectively. As FIG. 15 indicates, the illustrative embodiment which optimizes the bias Vb for the non-image area (where Vsg is detected) is successful in obtaining Vsg more stably than in the prior art and controlling the toner concentration accurately to a target value.

While the above description has concentrated on a single developing unit, the present invention is similarly applicable to a copier of the type having a plurality of developing units (color copier). In the case of a color copier, toner supply is controlled by coupling the toner supply clutch for a predetermined period of time when $R\ control \leqq Vsp/Vsg$ or uncoupling it when $Rcontrol \leqq Vsp/Vsg$, i.e., by controlling the ratio of an output voltage associated with a toner pattern formed during idling to an output voltage associated with the background. The control over the color toner supply is not provided with a fixed value since the output of the photosensor PSN is susceptible to the developing ability of the developing unit (gap between developing roller and drum, characteristic of developing roller, and developer) and apt to prevent the toner concentration from reaching the target range (2.5 Wt %).

In summary, it will be seen that the present invention provides an image density control method which increases the sensitivity of a sensor relative to the density of a pattern image and thereby allows the pattern image density to be sensed with accuracy. This is because the present invention forms the pattern image under a particular image forming condition which causes the output of the sensor to lie in a range where the sensed value noticeably changes in response to a change in density. When the sensed pattern image density is corrected in matching relation to the image forming condition to normalize it to the sensed value associated with the density range of the exposed pattern, there can be obtained a sensed value representative of the density of a pattern image formed by an image forming condition which directly reproduces the exposed pattern density.

A non-image area corresponding to the background is formed under another particular image forming condition which contaminates the background less than the above-mentioned particular condition assigned to the pattern image. This frees the background from carrier deposition or excessive contamination, thereby insuring accurate background density.

The sensor, therefore, can be readily set in a density range capable of sensing both the background density and the pattern image density with high sensitivity. It follows that both the pattern image density and the background density can be sensed accurately with high sensitivity.

Various modifications will become possible for those skilled in the art after receiving the teachings of the present disclosure without departing from the scope thereof.

What is claimed is:

1. In an image density control method comprising the steps of:

(a) exposing a charged surface of a photoconductive element by a reference pattern having a high density to electrostatically form a corresponding latent image on said photoconductive element;

(b) developing said latent image by a toner stored in a developing unit to convert said toner image to a toner pattern image;

(c) sensing a reflection from said toner pattern image and a reflection from a background area on said photoconductive element by a photosensor; and (d) controlling the supply of a toner to said developing unit on the basis of a comparison between a first input voltage representative of a toner density of a portion of said photoconductive element where no toner has been applied, and a second input voltage representative of a toner density of said toner pattern image, such that if said first input voltage is less than the second input voltage by a predetermined amount, a microprocessor couples a toner supply clutch to said developing unit in order to supply toner thereto, and if said first input voltage is greater than the second input voltage by said predetermined amount, the microprocessor uncouples said toner supply clutch from said developing unit;

the improvement wherein said pattern image is formed under a particular image forming condition which causes the output of said sensor to lie in a range where a sensed value noticeably changes in response to a change in density, while said background area is formed under another particular image forming condition which contaminates the background area less than said particular image forming condition assigned to said pattern image.

2. A method as claimed in claim 1, wherein said image forming conditions each comprises setting a bias voltage for development to be applied to said developing unit.

3. A method as claimed in claim 2, wherein the bias voltage is changed when the latent image of said pattern and said non-image area formed on said photoconductive element advance to said developing unit.

4. An image density control method according to claim 1, wherein said microprocessor executes an initialization procedure in a free-run mode without a paper sheet for use in copying a reference pattern.

5. An image density control method according to claim 1, wherein a sensor pattern sampling procedure is executed at a predetermined interval between a time when a light-emitting diode of said photosensor is turned on to read a density of said toner pattern image and a time when the sampling ends.

6. An image density control method according to claim 1, wherein said first and second input voltages are calculated from the mean average values of a plurality of density measurements taken during a sampling mode.

7. An image density control method according to claim 6, wherein once the mean average values are obtained, the sampling mode is ended and a threshold counter is initialized in order to begin a toner pattern sampling procedure.

8. An image density control method according to claim 1, wherein a grid output setting routine is executed at a predetermined time prior to a charging operation of the photoconductive element.

9. An image density control method according to claim 1, wherein toner end and near-end modes are used to determine the points at which toner is to be applied to the developing means.

* * * * *